US005203156A

United States Patent [19]

Yun

[11] Patent Number: 5,203,156

[45] Date of Patent: Apr. 20, 1993

[54] PROCESS FOR PRODUCING AN ANGORA RABBIT HAIR YARN

[75] Inventor: Kiyong Yun, Kyungki, Rep. of Korea

[73] Assignee: Hanol Angora Fabric Co. Ltd., Seoul, Rep. of Korea

[21] Appl. No.: 748,832

[22] Filed: Aug. 23, 1991

[30] Foreign Application Priority Data

Aug. 24, 1990 [KR] Rep. of Korea ..... 90-13144

[51] Int. Cl.[5] ..... D01H 7/52; D01H 13/30

[52] U.S. Cl. ..... 57/295; 8/111; 57/75; 57/257; 427/397.7

[58] Field of Search ..... 57/252, 257, 295, 75; 19/129 R, 100; 8/111; 427/397.7

[56] References Cited

U.S. PATENT DOCUMENTS 2,443,512 6/1948 Powers et al. ..... 427/397.8 X
3,063,128 11/1962 Etchison ..... 427/397.7 X
3,696,600 10/1972 Mayer, Jr. et al. ..... 57/402 X
3,835,638 9/1974 Mayer, Jr. et al. ..... 57/402 X
4,002,019 1/1977 Egbers et al. ..... 57/224
4,141,121 2/1979 Trifunovic ..... 57/236 X
4,519,198 5/1985 Kissel ..... 57/100 X

*Primary Examiner*—Joseph J. Hail, III
*Attorney, Agent, or Firm*—Watson, Cole, Grindle & Watson

[57] ABSTRACT

A process for producing 100% angora rabbit hair yarn, which comprises chemically treating a natural angora rabbit hair to increase scale and crimp on the surface of the angora rabbit hair, whereby imparting spinnability that is similar to that of wool, applying a conventional softening agent and an antistatic agent, carding, gillinng, spinning and twisting under suitable conditions that meet the properties of the angora rabbit hair.

7 Claims, 1 Drawing Sheet

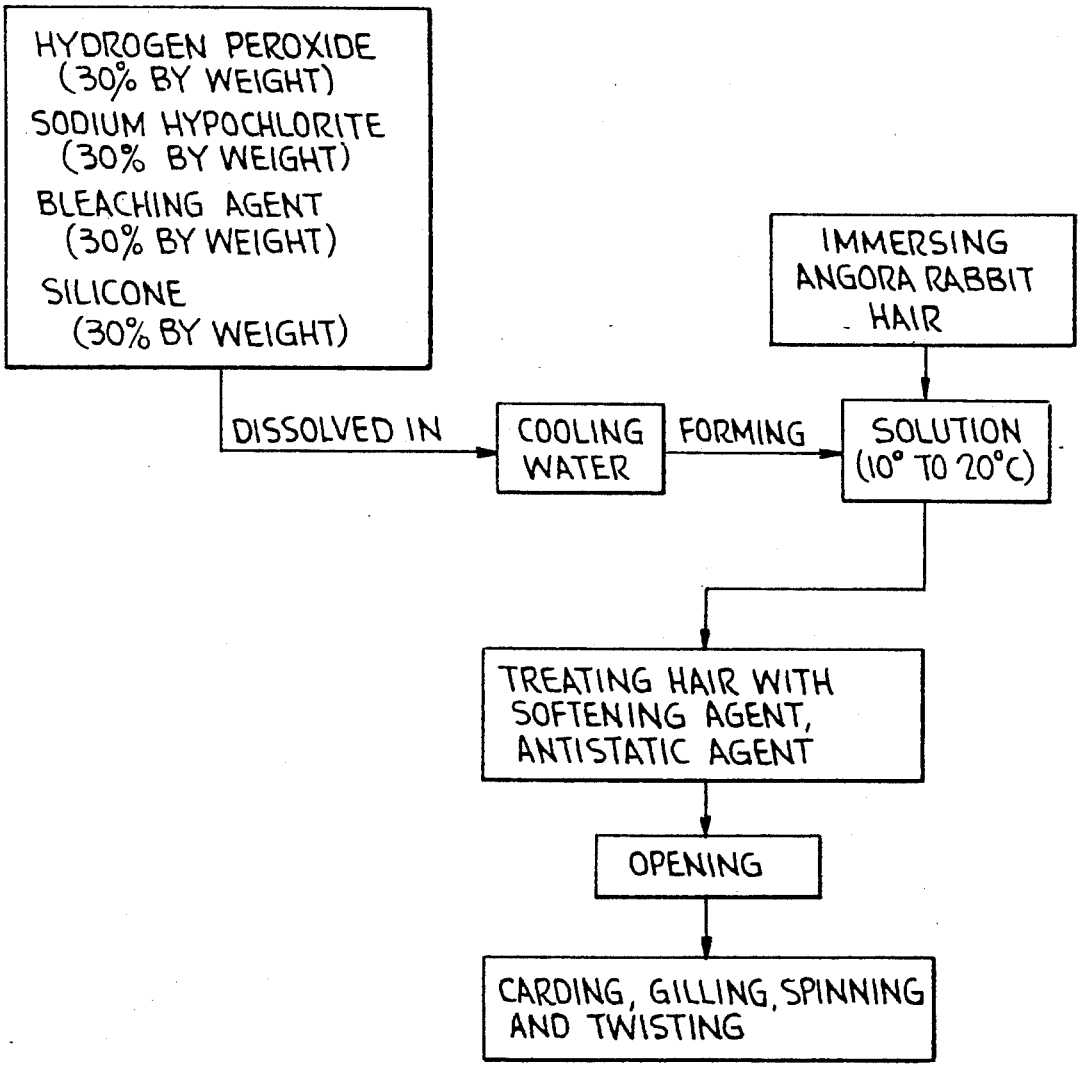
HYDROGEN PEROXIDE (30% BY WEIGHT)
SODIUM HYPOCHLORITE (30% BY WEIGHT)
BLEACHING AGENT (30% BY WEIGHT)
SILICONE (30% BY WEIGHT)
DISSOLVED IN
COOLING WATER
FORMING
IMMERSING ANGORA RABBIT HAIR
SOLUTION (10° TO 20°C)
TREATING HAIR WITH SOFTENING AGENT, ANTISTATIC AGENT
OPENING
CARDING, GILLING, SPINNING AND TWISTING

PROCESS FOR PRODUCING AN ANGORA RABBIT HAIR YARN

BACKGROUND OF THE INVENTION

The present invention relates to a process for producing 100% angora rabbit hair yarn using angora rabbit hair having a fiber diameter of 12 to 14μ and an average fiber length of about 60 mm, and more particularly relates to a process for preparing an angora rabbit hair fine yarn, which comprises specifically chemically treating an angora rabbit hair to increase its spinnability and worsted spinning it.

Since angora rabbit hair has excellent luster, warmth retaining properties and flexibility, it has ideal properties for use as fibers. However, since it has little scale and crimp as compared to other animal fibers, the spinnability thereof is very poor, and thus, it has been difficult to produce a fine spun yarn.

Korean Patent Publication NO. 80-1643 discloses a process for spinning angora rabbit hair and an endless medium yarn that consolidates the fibers by using the endless medium yarn that has the range of one-third of the crosssectional area of the total fiber in order to produce a 60 Nm or greater fine yarn from the angora rabbit hair. Since the prior art spins the angora rabbit hair together with a separate medium yarn having properties that differ from the rabbit hair, the apparatus for producing the angora rabbit hair yarn is very complicated, high costs are required for making the hair yarn, and it is difficult to prepare angora rabbit hair yarn that completely retains the excellent properties of angora rabbit hair, due to the use of the medium yarn.

German Patent No. 916155 discloses an angora rabbit hair yarn, wherein a central core twisted yarn is coated with an angora rabbit hair, the strength of such hair yarn being determined by the strength of the core yarn. And the coated portions of the hair core yarn provides the properties of the angora rabbit hair yarn. Since the patent utilizes a core yarn that is different from the angora rabbit hair, it also has faults that are similar to those of the above described technique.

Korea Patent Publication No. 87-1886 describes a process for spinning a 6 Nm angora rabbit hair thick yarn using a core consisting of a short angora rabbit hair having a length between 1.5 and 2 cm or less and a middle angora rabbit hair having a length of 2.0 to 4.0 cm and an effective hair of a long angora rabbit hair having a length of 4.0 cm or more. However, since it is difficult and complicated to sort angora rabbit hair into short, middle and long length hairs having the above defined lengths, the depilation ratio is high due to the weak consolidating forces between the hairs. Also the relatively rough long hair is used as the effect hair, and the process also has disadvantages in obtaining the best feeling.

SUMMARY OF THE INVENTION

The object of the present invention is to provide a process for producing a 100% angora rabbit hair fine yarn useful as a grey yarn for woven fabrics and knitted fabrics. This process comprises chemically treating a natural angora rabbit hair to form a scale similar to the surface structure of wool on the surface of the angora rabbit hair to increase the number of crimp from 1 or 2 to 5 through 8, whereby the hair having the spinnability similar to that of wool is made, and spinning the angora rabbit hair under suitable spinning conditions that coincide with the properties of the angora rabbit hair.

BRIEF DESCRIPTION OF THE DRAWING

The single drawing is a block diagram of the basic steps employed in carrying out the invention.

DETAILED DESCRIPTION

Hereinafter, a process according to a preferred embodiment of the present invention will be described in detail. The basic steps involved are set forth in block diagram in the drawing.

1. Chemical Treatment

30% by weight of 50% strength hydrogen peroxide solution, 30% by weight of 65% strength sodium hypochlorite solution, 30% by weight bleaching agent and 10% by weight of 70% strength silicone were mixed, and then the mixture was added to water to prepare a 3% strength solution. The solution was maintained at the temperature of 10 to 12 C., and then an angora rabbit hair was immersed into the solution for about 50 min.

This chemical treatment dissolves and removes the core-muscle from the rabbit hair, which was included in the fiber to impair the softness of the angora rabbit hair, from the rabbit hair, so that the fiber became pliable and 5 through 8 crimps were generated, and the fine projection texture of the cuticule surrounding the scale was removed to expose a wool-like scale on the surface.

The treated angora rabbit hair was washed, and then a softening agent and an antistatic agent were applied thereto to prepare a grey yarn for spinning, while maintaining the moisture content of the angora rabbit hair within the range of 16 to 18%.

2. Carding

The treated angora rabbit hair was opened on an opening machine, and then carded on a worsted type carding machine to obtain a silver having a weight of 10 g/m.

The worsted type carding machine used in the present invention has one cylinder and 12 to 18 needles/in$^2$ of the needle density, and the space between the cylinder and worker is maintained in the range of 0.3 to 0.4 mm. The temperature and the humidity (RH) are maintained in the range of 25° to 30° C. and 70 to 85%, respectively. If such conditions are not satisfied, slub or nap are generated during the carding, and the carding cannot be effected smoothly, 3. Gilling The gilling is carried out in four steps. The pin density of the gill box is 14 pins/in$^2$ at the first step, 16 pins/in$^2$ at the second step, 18 pins/in at the third step and 23 pins/in$^2$ at the last step.

In addition, a nip roller having a diameter of 20 mm and a front bottom roller having a diameter of 40 mm are used in the present invention, and the gap between the nip roller and the last faller is maintained at 20 mm.

In general, although a gill box, having pin densities of 12 pins/in$^2$., 13 pins/in$^2$, 15 pins/in$^2$, and 16 pins/in$^2$ in that order, is used in the worsted spinning operation, since the fineness of the angora rabbit hair is very small, a gill box having a high pin density should be used in the present invention to carry out the gilling smoothly. In addition, since the fiber length of the angora rabbit hair is short, a nip roller having a diameter of 20 mm and a front bottom roller having a diameter of 40 mm were used. These diameters are smaller than those used for the conventional worsted spinning, which is 22 mm and 62 mm diameters, respectively. The gilling can be carried out smoothly by maintaining the 20 mm gauge, which is shorter than that of the 35 to 40 mm adopted in the conventional worsted spinning.

4. Spinning

The spinning of the present invention is carried out using a conventional ring spinning machine which is comprised of four rows of rollers. Since the fiber length of the angora rabbit hair is short, the gaps between the back roller and the front roller are maintained in the order of 60 mm, 55 mm and 45 mm. The bottom roller has a diameter of 25 mm. (In the case of the conventional worsted spinning, the gaps from the back roller to the front roller are maintained at 80 mm, 70 mm and 70 mm, succesively, and the diameter of the bottom roller is 30 mm.) In addition, the twist factor in the present invention is 15% greater than that of worsted yarn. If such conditions are not satisfied, angora rabbit hair yarn having excellent evenness cannot be prepared smoothly.

5. Twisting

In doubling and twisting two single yarns of a angora rabbit hair yarn prepared from the spinning machine, the direction of the first twist is opposite to that of the second twist, and the number of twist of the second twist at the twisting machine is 0.59 to 0.70 times that of the first twist (i.e., the number of twist of the single yarn).

Even though the angora rabbit hair yarn is treated with steam, it will not be twist-set. In addition, if angora rabbit hair yarn is twist-set slightly, the state of the twist-set will recover with the lapse of time.

However, in the present invention, instead of twist-setting treatment by steam, the shape stability can be maintained continuously by retaining the numbers of twist of the first twist and the second twist within the aforementioned range and subjecting the direction of the twist to be opposite to each other. If the number of twist deviates from such range, the quality of the product will depreciate after weaving or knitting, since the grey yarn is flocked in one direction.

EXAMPLE

100% angora rabbit hair yarn 2/60's were prepared by using 100 Kg of angora rabbit hair.

1. Chemical treatment

1) Treating bath was charged with 200 l of cooling water (11° C.).

| | | |
|---|---|---|
| 2) | Hydrogen peroxide | 1.8 Kg |
| | Sodium hypochlorite | 1.8 Kg |
| | Bleaching agent | 1.8 Kg |
| | Silicone | 0.6 Kg |
| | TOTAL | 6.0 Kg |

The above mixture was added to the cooling water in the treating bath, mixed and dissolved.

3) The treating liquor was sprayed for 50 min to carry out the chemical treatment, while circulating the treating liquor.

4) Upon completing the chemical treatment, the treating liquor was discharged. Then, the angora rabbit hair was washed to remove the residues remaining in the rabbit hair.

5) Thus treated angora rabbit hair was immersed into the treating bath to which 600 g of softening agent is incorporated to effect the softening treatment, and then drying with ventilation in the room, so that the moisture content is maintained at 16 to 18%.

6) 300 g of softening agent and 300 g of antistatic agent were mixed to give a 10% strength solution, solution was sprayed onto the angora rabbit hair while laminating it, and then the wet angora rabbit hair was allowed to stand for 8 hours.

2. Carding

The thus obtained angora rabbit hair was opened on the opener, and then carded on the worsted carding machine having one cylinder to give 10 g/m of silver. At that time, the needle density is 16 needles/in$^2$, and the gap between the cylinder and the worker is 0.3 mm. The temperature and humidity of the carding chamber is maintained at 28° C., 80% (RH).

3. Gilling

| Machinery name | Number of doubling | Draft | Output (g/m) |
|---|---|---|---|
| Auto Gill | 12 | 9.5 | 12.6 |
| High Gill | 3 | 6 | 6.3 |
| Open Gill | 2 | 6 | 2.1 |
| Bobbiner | 1 | 6 | 0.35 |

| | |
|---|---|
| 4. Spinning (using ring spinning machine) | |
| Size of the feed roving | 0.35 g/m |
| Draft | 21 |
| The number of twist | 720 T/M.(S) |
| Spindle velocity | 9000 rpm |
| output count | 1/60's |
| 6. Twisting (using spindle twister) | |
| Size of product | 2/60's |
| The number of twist | 474 T/M.(S) |

What is claimed is:

1. A process for producing an angora rabbit hair yarn, comprising the steps of dissolving a mixture of 30% by weight of hydrogen peroxide, 30% by weight of sodium hypochlorite, 30% by weight of bleaching agent and 10% by weight of silicone into cooling water to form a solution having a temperature of 10° to 12° C., immersing an angora rabbit hair into said solution for 50 min., treating the angora rabbit hair with a softening agent and an antistatic agent, opening the angora rabbit hair after completing the above steps, carding, gilling, spinning the twisting the treated angora rabbit hair, wherein the carding is carried out using a worsted type carding machine having one cylinder with a needle density of 12 to 18 needles/in.$^2$ and a gap between the cylinder and a worker of 0.3 to 0.4 mm, wherein the gilling is carried out in four steps using a gilling machine having a pin density of 14 pins/in.$^2$, 16 pins/in.$^2$, 18 pins/in.$^2$ and 23 pins/in.$^2$, in order, and the diameters of a nip roller and a front bottom roller is 20 mm and 40 mm, respectively, wherein the spinning is carried out using a ring spinning machine having four rows of rollers of which the gaps from the back roller to the front roller are 60 mm, 55 mm and 45 mm, respectively, and the diameter of the bottom roller is 25 mm, and wherein the twisting is carred out by opposing the direction of a second twist to that of a first twist and making the number of twists of the second twist to be 0.59 through 0.70 times that of the first twist.

2. A process for producing an angora rabbit hair yarn, comprising the steps of dissolving a mixture of 30% by weight of hydrogen peroxide, 30% by weight of sodium hypochlorite, 30% by weight of bleaching agent and 10% by weight of silicone into cooling water to form a solution having a temperature of 10° to 12° C., immersing an angora rabbit hair into said solution, treating the angora rabbit hair with a softening agent and an antistatic agent, opening the angora rabbit hair after completion of the above steps, and carding, gilling, spinning and twisting the treated angora rabbit hair.

3. The process according to claim 2, wherein the angora rabbit hair is immersed into said solution for 50 min.

4. The process according to claim 2, wherein the carding is carried out using a worsted type carding machine having one cylinder with a needle density of 12 to 18 needles/in.$^2$ and a gap between the cylinder and a worker of 0.3 to 0.4 mm.

5. The process according to claim 2, wherein the gilling is carried out in four steps using a gilling machine having a pin density of 14 pins/in.$^2$, 16 pins/in.$^2$, 18 pins/in.$^2$ and 23 pins/in.$^2$, in order, and the diameters of a nip roller and a front bottom roller is 20 mm and 40 mm, respectively.

6. The process according to claim 2, wherein the spinning is carried out using a ring spinning machine having four rows of rollers of which the gaps from the back roller to the front roller are 60 mm, 55 mm and 45 mm, respectively, and the diameter of the bottom roller is 25 mm.

7. The process according to claim 2, wherein the twisting is carried out by opposing the direction of a second twist to that of a first twist and making the number of twists of the second twist to be 0.59 through 0.70 times that of the first twist.

* * * * *